US011659877B1

(12) United States Patent
Gonzales

(10) Patent No.: US 11,659,877 B1
(45) Date of Patent: May 30, 2023

(54) HEM PROTECTOR

(71) Applicant: Sonja Ann Gonzales, Everett, WA (US)

(72) Inventor: Sonja Ann Gonzales, Everett, WA (US)

( * ) Notice: Subject to any disclaimer, the term of this patent is extended or adjusted under 35 U.S.C. 154(b) by 286 days.

(21) Appl. No.: 16/557,662

(22) Filed: Aug. 30, 2019

Related U.S. Application Data

(60) Provisional application No. 62/782,514, filed on Dec. 20, 2018.

(51) Int. Cl.
*A41D 27/14* (2006.01)
*A41D 1/06* (2006.01)
*A41D 27/08* (2006.01)

(52) U.S. Cl.
CPC ..... *A41D 27/145* (2013.01); *A41D 1/06* (2013.01); *A41D 27/085* (2013.01)

(58) Field of Classification Search
CPC ..... A41D 1/06; A41D 27/085; A41D 27/145; F21V 33/0008; C09J 7/40; F21V 21/0808
See application file for complete search history.

(56) References Cited

U.S. PATENT DOCUMENTS 4,761,720 A * 8/1988 Solow ..... F21S 4/24 362/249.14
6,013,346 A * 1/2000 Lewis et al. ..... G09F 9/33 428/42.1
6,618,862 B1 9/2003 Bunjes
6,829,847 B2 12/2004 O'Shea et al.
7,404,215 B2* 7/2008 Allen ..... A41D 27/145 2/232
7,506,383 B2* 3/2009 Chard ..... A45D 44/02 2/60
7,748,058 B2* 7/2010 Steitle ..... A41D 27/08 2/232
9,379,289 B1* 6/2016 Lindblad et al. ..... F21S 4/24
9,897,292 B1* 2/2018 Lindblad et al. ..... H01L 24/00
2009/0263606 A1* 10/2009 Nonaka et al. ..... B32B 27/16 428/41.3
2010/0220046 A1* 9/2010 Plotz et al. ..... G02F 1/133603 362/249.02
2010/0287678 A1* 11/2010 Myers ..... A41D 27/145 2/60
2014/0252986 A1* 9/2014 Safar ..... H05B 45/20 315/294
2015/0007373 A1* 1/2015 Martin ..... A41B 7/12 2/60
2018/0149346 A1* 5/2018 Rapisarda ..... F21V 31/005
2020/0187577 A1* 6/2020 Moores ..... A41D 27/12

* cited by examiner

*Primary Examiner* — Khoa D Huynh
*Assistant Examiner* — Erick I Lopez
(74) *Attorney, Agent, or Firm* — Davis Wright Tremaine LLP; Heather M. Colburn

(57) ABSTRACT

A hem cover for use with a trouser leg constructed from at least one material having an interior side and an exterior side. The hem cover has an outwardly facing side opposite an inwardly facing side. The hem cover is positionable along an edge of the trouser leg and foldable to position a first portion of the inwardly facing side along the interior side and a second portion of the inwardly facing side along the exterior side of the at least one material. The inwardly facing side includes an adhesive layer configured to temporarily adhere to the first and second portions to the interior and exterior sides, respectively, to thereby cover a covered portion of the edge of the trouser leg.

33 Claims, 5 Drawing Sheets

HEM PROTECTOR

CROSS REFERENCE TO RELATED APPLICATION(S)

This application claims the benefit of U.S. Provisional Application No. 62/782,514, filed on Dec. 20, 2018, which is incorporated herein by reference in its entirety.

BACKGROUND OF THE INVENTION

Field of the Invention

The present invention is directed generally to hem protectors.

Description of the Related Art

Without hem protectors, debris and moisture may accumulate along the edges of the leg openings at the bottom of a pair of long pants or trousers. In particular, the edges of the leg openings may become saturated with moisture in rainy or snowy environments. Once the edge of the leg opening has become wet, capillary action is likely to cause more of the trouser leg to become wet. Wet trousers can cause discomfort to the wearer, absorb colored dye from the wearer's shoes into the fabric of the trousers, transfer colored dye from the wearer's trousers to the wearer's shoes, and generally cause an unsightly presentation.

Traditionally, hem protectors have relied on interaction between the wearer's trouser legs and the wearer's shoes. For instance, one type of hem protector includes a protrusion that is attached to the heel of the wearer's shoe and functions as a physical barrier that prevents the wearer's trouser leg from dropping below the protrusion. Unfortunately, this type of hem protector does not guard the edge of the leg opening from moisture. Alternatively, another type of hem protector uses a fastener to attach the bottom of the trouser leg to the heel of the wearer's shoe. Unfortunately, the fastener can permanently damage the wearer's shoe and/or the wearer's trouser leg. Further, this type of hem protector does not guard the edge of the leg opening from moisture.

BRIEF DESCRIPTION OF THE SEVERAL VIEWS OF THE DRAWING(S)

The present invention will be described by way of exemplary embodiments, but not limitations, illustrated in the accompanying drawings in which like references denote similar elements.

DETAILED DESCRIPTION OF THE INVENTION

Figure 1:
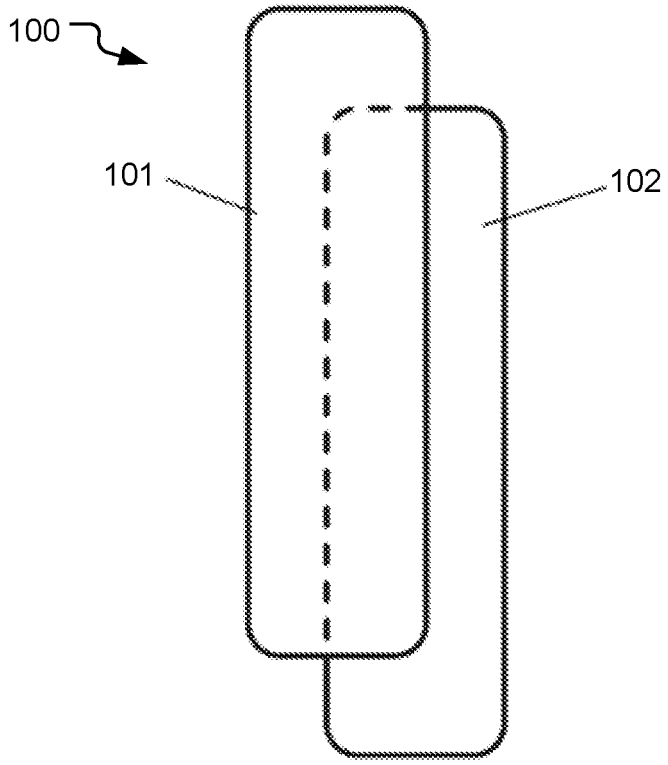
FIG. 1 is a top perspective view of a hem cover or protector and a backing.

Throughout the drawings, like reference characters are used to designate like elements. As used herein, the term "coupled" or "coupling" may indicate a connection. The connection may be a direct or an indirect connection between one or more items.

FIG. 1 is a top exploded perspective view of an assembly or package 100 that includes a hem cover or protector 101 and a backing sheet of material (referred to as a "backing" 102). A user may use the hem protector 101 and methods related to the hem protector 101 to protect and/or decorate at least a portion of an edge 310 (see FIG. 7) defining an opening 312 (see FIG. 11) at a bottom 314 (see FIG. 8) of a leg 300 (see FIGS. 5, 7, 8, 11, and 12) of a pair of long pants or trousers 320 (see FIG. 12). The user may be anybody of any age, including a man, a woman, a teenager, a child, and the like.

Figure 7:
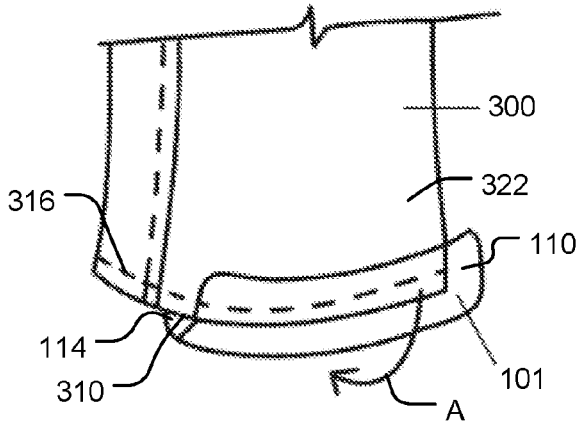
FIG. 7 is a diagram illustrating a second step of the method of attaching the hem protector to the trouser leg.
Figure 11:
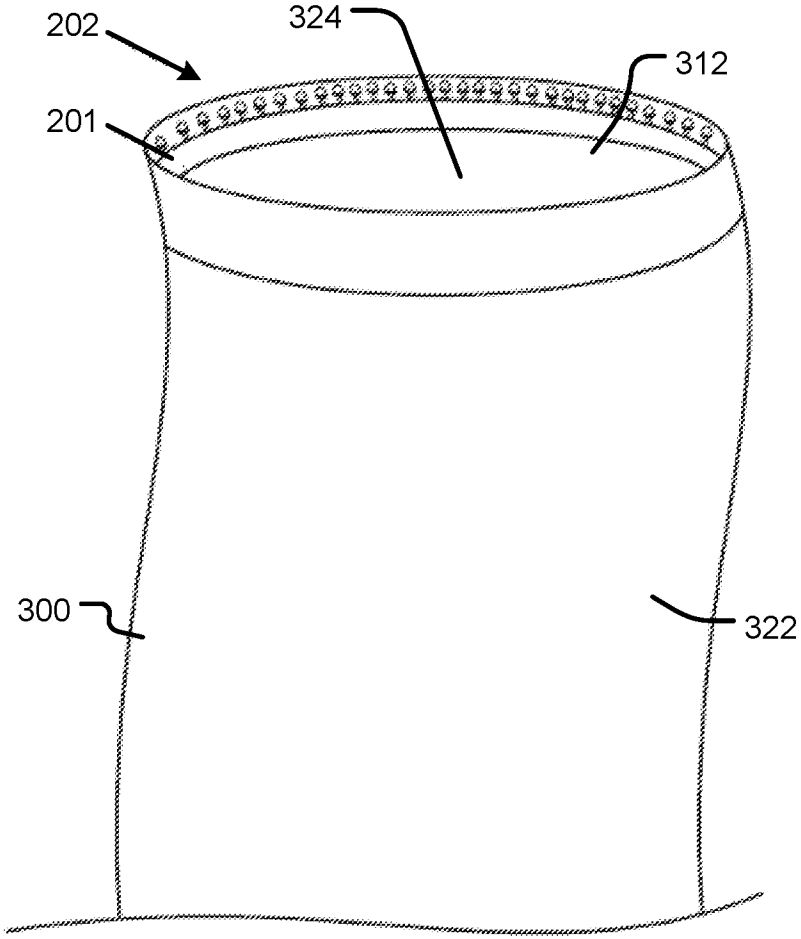
FIG. 11 is a top perspective view of the lighted hem protector of FIG. 9 attached to the trouser leg.

Referring to FIG. 11, the trouser leg 300 is constructed from at least one material (e.g., a fabric) having an exterior side 322 opposite an interior side 324 that faces into the trouser leg 300. For ease of illustration, the material(s) will be referred to below as being a fabric. Referring to FIG. 7, the edge 310 may be formed by hemming the trouser leg 300. For example, the trouser leg 300 may be turned over or folded to place a free end of the trouser leg 300 against a portion of the trouser leg 300. Then, the free end may be stitched (with stitches 316) to the portion of the trouser leg 300. However, the edge 310 need not actually be formed by hemming.

Figure 2:
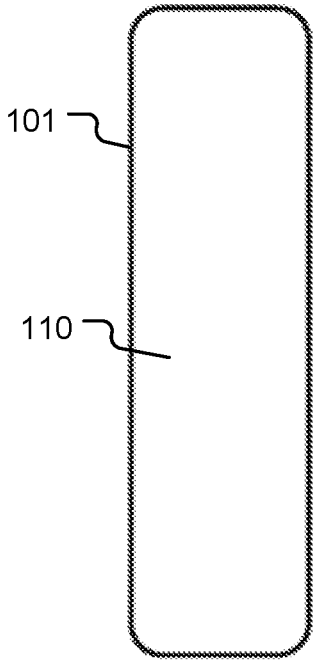
FIG. 2 is a top view of the hem protector of FIG. 1.
Figure 3:
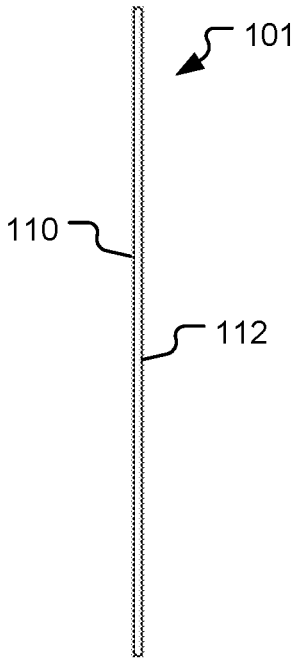
FIG. 3 is a side view of the hem protector of FIG. 1 illustrating the general thinness of the hem protector relative to its length.
Figure 4:
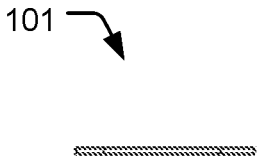
FIG. 4 is a side view of the hem protector of FIG. 1 illustrating the general thinness of the hem protector relative to its width.
Figure 5:
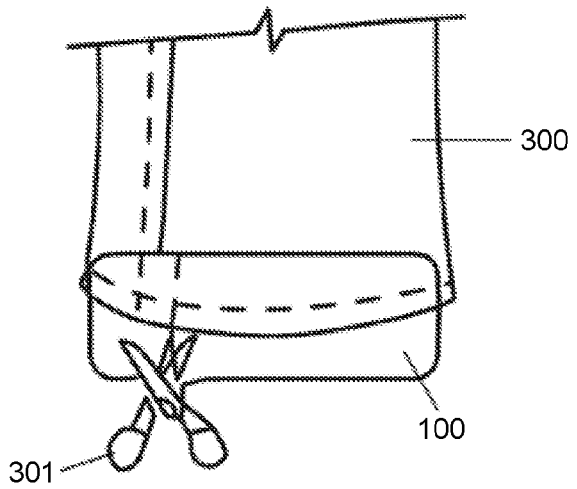
FIG. 5 is a diagram illustrating the hem protector being modified for use with a trouser leg.

FIG. 2 is a top view of the hem protector 101. As illustrated, the hem protector 101 may have a generally rectangular outer shape with curved or rounded corners. FIG. 3 is a side view of the hem protector 101 illustrating the general thinness of the hem protector 101 relative to its length. FIG. 4 is a side view of the hem protector 101, illustrating the general thinness of the hem protector 101 relative to its width.

As illustrated in FIGS. 2-4, the hem protector 101 may be constructed from a generally flat sheet of waterproof material. For example, the hem protector 101 may be constructed from a polymer sheet. The hem protector 101 may be transparent or tinted. Alternatively, the hem protector 101 may be at least partially opaque and/or translucent. The hem protector 101 may be disposable and, in at least some embodiments, the hem protector 101 may be replaceable and/or reusable.

Referring to FIG. 3, the hem protector 101 has an outwardly facing side 110 opposite an inwardly facing side 112. The hem protector 101 may have a thickness within a range of 2.5 thousandths of an inch ("mils") to 3 mils. The thickness is defined from the outwardly facing side 110 to the inwardly facing side 112. Typically, a hem protector having a thickness that is less than 2.5 mils is not sufficiently durable to protect the edge 310 (see FIG. 8) from inclement weather. On the other hand, a hem protector having a thickness that is greater than 3 mils is typically not sufficiently flexible to bend on clothing.

Figure 8:
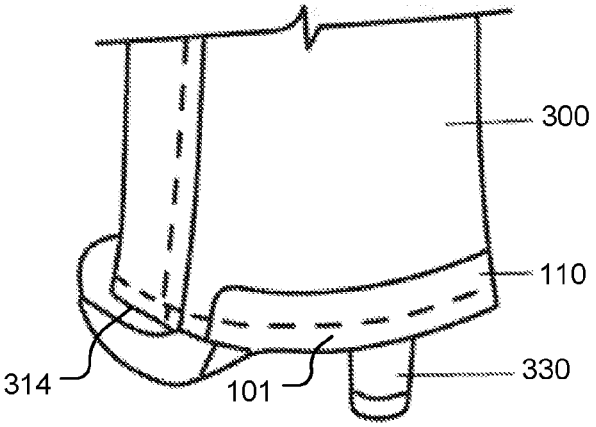
FIG. 8 is a diagram illustrating the hem protector attached to the trouser leg.

Referring to FIG. 8, the hem protector 101 may be transparent or sufficiently clear to render the hem protector 101 not readily identifiable or noticeable when viewed from the exterior of the trouser leg 300. Alternatively, the hem protector 101 may be designed to blend visually with the trouser leg 300 or to go unnoticed by others. For example, the outwardly facing side 110 may be a denim blue color and/or include a denim pattern configured to match a specific color and/or pattern of a pair of jeans. A plurality of hem protectors, each like the hem protector 101, may each have an outwardly facing side that is a different color (e.g., shades of blue and/or white) to accommodate different colors of trousers (e.g., jeans). Such a plurality of hem protectors may be sold together as a kit.

Alternatively, the hem protector 101 may be designed to be visible along the edge 310 (see FIG. 7). In such embodiments, the outwardly facing side 110 may be configured to enhance the appearance of the clothing (e.g., the trouser leg 300 and/or the trousers 320 illustrated in FIG. 12). For example, the outwardly facing side 110 may be a solid color or include one or more colors arranged in a pattern, or a print. The outwardly facing side 110 may include any nature of decoration. For example, the outwardly facing side 110 may include a floral pattern, a plaid design, an Aztec print, an arbitrary design, and the like. The outwardly facing side 110 may have one or more designs, characters, and/or words printed thereupon or formed in (e.g., embossed on) the hem protector 101. Such designs may include different ornamental colorful shapes. The outwardly facing side 110 may be reflective and/or include reflective regions. The outwardly facing side 110 may include glitter, beads, sequins, and/or other types of embellishments.

By way of another non-limiting example, the outwardly facing side 110 may have one or more slogans printed thereupon and/or include glitter. The outwardly facing side 110 may include custom designs, pictures, and/or sayings. For example, the outwardly facing side 110 may include one or more custom logos and/or designs (e.g., I♥NY, BACK OFF, #CUTE, and the like). The outwardly facing side 110 may be used to express whatever the user desires.

Figure 6:
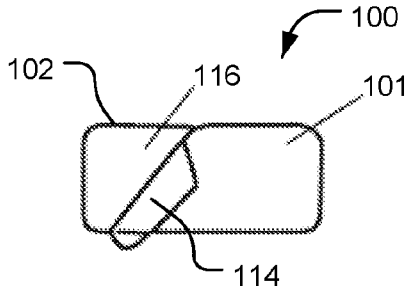
FIG. 6 is a diagram illustrating a first step of a method of attaching the hem protector to the trouser leg.

Referring to FIG. 6, the hem protector 101 has an adhesive coating or layer 114 applied to the inwardly facing side 112 (see FIG. 3). The adhesive layer 114 may be temporarily fitted or attached to the backing 102 to thereby attach the hem protector 101 to the backing 102 and form the package 100. Referring to FIG. 7, the hem protector 101 may be removed (e.g., peeled) from the backing 102 (see FIGS. 1 and 6) and affixed, by the adhesive layer 114, to the trouser leg 300 along the edge 310 (see FIG. 7). In other words, the hem protector 101 may be applied to the exterior side 322 and the interior side 324 (see FIG. 11) of the fabric of the trouser leg 300 by the adhesive layer 114, which is capable of sticking to fabric surfaces.

Referring to FIG. 6, the backing 102 may be constructed from paper with an applied wax coating 116 that facilitates the adhesive layer 14 of the hem protector 101 being peeled away from the wax coating 116.

A user may not desire to use the full length or width of the hem protector 101. When this is the case, referring to FIG. 5, the user may use a cutting tool 301 (e.g., scissors) to trim excess dimensionality from the package 100 before the hem protector 101 (see FIGS. 1-4 and 6-8) is peeled from the backing 102 (see FIGS. 1 and 6). For instance, a user may measure the length of the package 100 and use the cutting tool 301 to trim the package 100 to a preferable length.

Referring to FIG. 8, the hem protector 101 is particularly well suited for placement along the edge 310 (see FIG. 7) of the opening 312 (see FIG. 11) at the bottom 314 of the trouser leg 300. After the user has optionally trimmed the package 100 (see FIGS. 1 and 5), the user may apply the hem protector 101 to at least a portion of the edge 310 (see FIG. 7). Referring to FIG. 6, to apply the hem protector 101 along the edge 310 (see FIG. 7), the user peels the hem protector 101 from the backing 102. Next, referring to FIG. 7, with the adhesive layer 114 facing directed towards the trouser leg 300, the user applies approximately half the width of the hem protector 101 to the exterior side 322 of the fabric of the trouser leg 300 along the edge 310 and then folds the hem protector 101 lengthwise in a direction identified by a curved arrow "A" and applies the remaining half of the hem protector 101 to the interior side 324 (see FIG. 11) of the fabric of the trouser leg 300. The user may press the adhesive layer 114 against the exterior side 322 and the interior side 324 (see FIG. 11) of the fabric to ensure the hem protector 101 is adequately adhered along and covers the covered portion of the edge 310. The result is shown in FIG. 8. As shown in FIG. 8, the wearer's shoe heal 330 may extend below the hem protector 101. Further, the hem protector 101 may be positioned at the rear (or heel side) of the trouser leg 300 to protect the trouser leg 300 from becoming soiled with debris or moisture (e.g., as the wearer walks). The hem protector 101 helps preserve the trouser leg 300 and helps protect the trouser leg 300 from water, dirt, germs, and grime. The hem protector 101 may also prevent fraying, rips, and tears along the covered portion of the edge 310 (see FIG. 7).

When the hem protector 101 is installed along the edge 310 (see FIG. 7), the hem protector 101 helps protect and/or preserve the trousers 320 (see FIG. 12), which may be an expensive new pair of pants (e.g., jeans), from being ruined by the outside environment. In other words, the hem protector 101 may be used to prolong the life and/or wearability of the trousers 320 (see FIG. 12), which saves the wearer money.

Referring to FIG. 7, the hem protector 101 may be removed from the trouser leg 300 by simply peeling the hem protector 101 from along the edge 310 (see FIG. 7). The adhesive layer 114 may be configured to cling to the inwardly facing side 112 (see FIG. 3) and release the fabric (e.g., without damaging the fabric) as the hem protector 101 is peeled away from the trouser leg 300.

Due to the flexibility and strength of the hem protector 101 (e.g., implemented as a polymer sheet), the adhesive layer 114 of the hem protector 101 may be used to facilitate or form a temporary hem. For example, the user may use a pair of hem protectors (each like the hem protector 101) to temporarily hem a pair of trouser legs to new reduced lengths. This is mainly done when the trouser legs are too long for the user. Instead of simply folding (or cuffing) the trouser legs to reduce their length, the user could instead use a pair of hem protectors (each like the hem protector 101) to form temporary hems. To accomplish this, the user folds up the trouser legs to determine a desired finished hem length. For example, the free ends of the trouser legs may each be folded to position the free end inside (or outside) its trouser leg. The user may then affix the pair of hem protectors along the edges defined by the folds in the trouser legs. The hem protector 101 is configured (e.g., wide enough) to extend upwardly beyond the free ends of the trouser legs. Thus, the adhesive layer 114 of each of the hem protectors may be adhered to the trouser fabric at a location above the free end. In this manner, the hem protectors may be wrapped around the folds formed in the trouser legs and adhered to the trouser fabric at a location above the free ends. Thus, the hem protectors may firmly hold the folds in place and form temporary hems. Such alterations, when made by a seamstress, are costly and permanent. The position of sewn hems cannot be changed without removing the stitching, which is time consuming and can damage the trouser legs. In contrast, a pair of hem protectors (each like the hem protector 101) allow the user to change the length of a pair of trouser legs whenever desired because the temporary hems created by the hem protectors are not permanent. The hem protectors may be removed by simply peeling them from along the edges of the trouser legs, which will release the temporary hems. Unlike with removing sewn hems, removing the hem protectors does not risk damaging the trouser legs. This allows the user to add and remove temporary hems as frequently as desired. For example, the user may change the length of the trouser legs depending on the shoes the wearer is wearing (e.g., high heels, flats, sandals, boots, and the like).

The hem protector 101 may be used to cover, mask, and/or hide an unsightly, stained, damaged, soiled, and/or frayed hem. In this manner, the hem protector 101 may make an old and ruined hem (e.g., on a leg of a pair of jeans) look like new or almost new.

Figure 9:
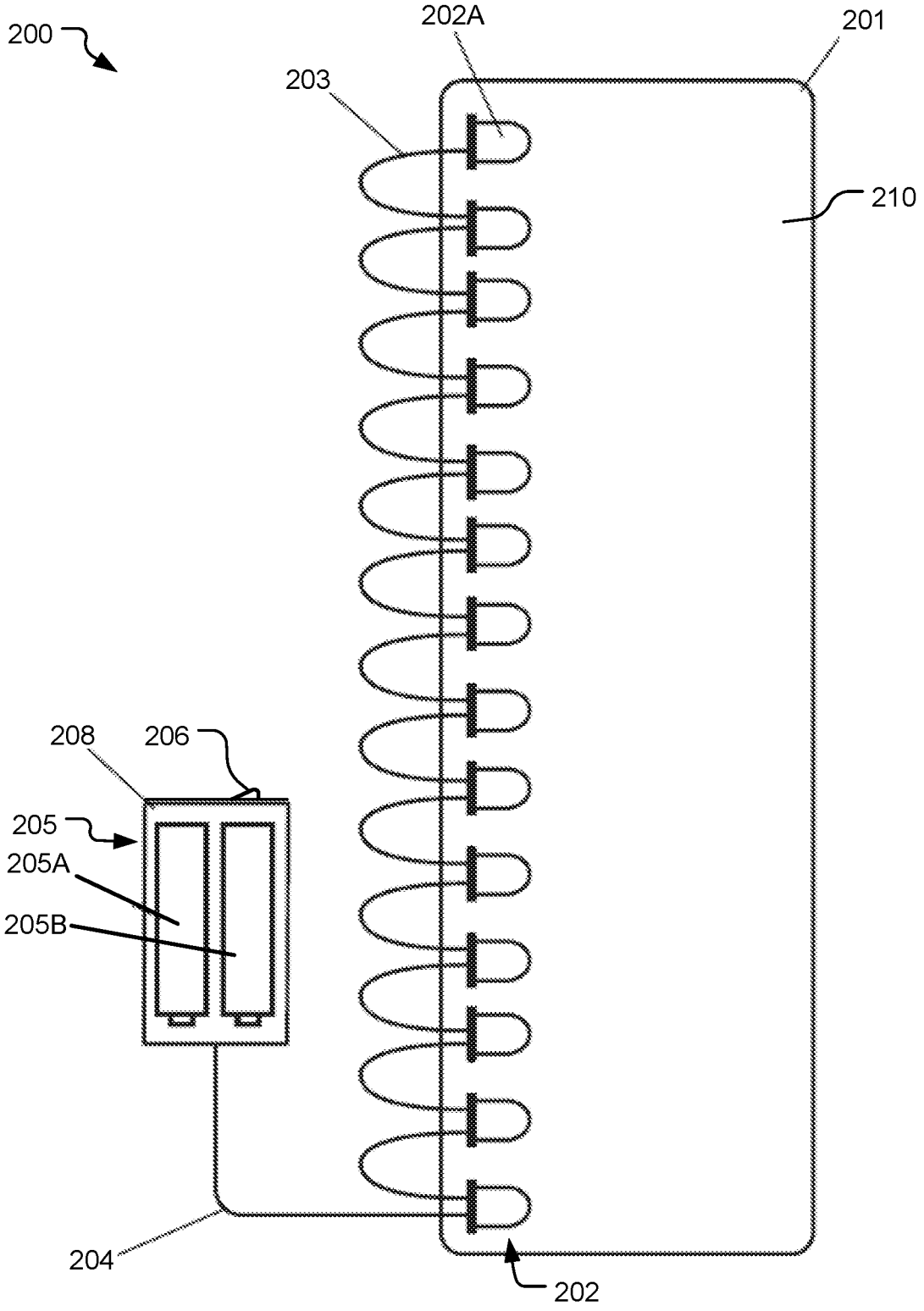
FIG. 9 is a top view of a lighted hem protector.

FIG. 9 is a top view of an embodiment of an assembly or a package 200 that includes a lighted hem protector 201 and the backing 102 (see FIGS. 1 and 6). The lighted hem protector 201 has an outwardly facing side 210 opposite an inwardly facing side (not shown). The outwardly facing side 210 may be substantially identical the outwardly facing side 110 (see FIGS. 2, 3, 7, and 8) of the hem protector 101 (see FIGS. 1-4 and 6-8). However, unlike the outwardly facing side 110, the outwardly facing side 210 includes one or more lighting elements 202 that illuminate the wearer's step position, shine on the ground when the wearer is walking, and/or bring more attention to the wearer's shoes or sneakers. Like the inwardly facing side 112 (see FIG. 3), the inwardly facing side (not shown) of the lighted hem protector 201 includes the adhesive layer 114 (see FIGS. 6 and 7). Thus, referring to FIG. 8, the lighted hem protector 201 (see FIGS. 9, 11, and 12) may be installed along the edge 310 of the trouser leg 300 in the same manner in which the hem protector 101 is installed along the edge 310 (discussed above).

Figure 10:
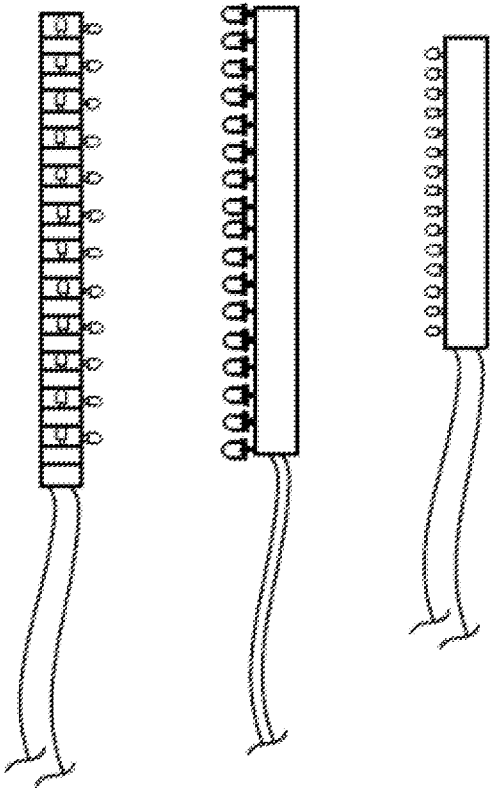
FIG. 10 is a top view of differently sized light emitting diode ("LED") strips that may be used to construct the lighted hem protector of FIG. 9.

Referring to FIG. 9, the lighting element(s) 202 is/are adhered to the outwardly facing side 210 of the lighted hem protector 201. Alternatively, the lighting element(s) 202 may be embedded in the lighted hem protector 201. The lighting element(s) 202 may produce monochromatic or polychromatic light within the visible light spectrum. In the embodiment illustrated, the lighting element(s) 202 are implemented as a plurality of lamps or light bulbs 202A. By way of a non-limiting example, the light bulbs 202A may each be implemented as a light emitting diode ("LED"). The light bulbs 202A are electronically connected (e.g., in series) to form a string or strip 203. FIG. 10 illustrates alternate embodiments of the strip 203 (see FIG. 9) that may be used to construct the lighted hem protector 201.

Referring to FIG. 9, the lighting element(s) 202 are electronically connected (e.g., by one or more wires 204) to a battery compartment 208 with a control means (e.g., a control switch 206). The battery compartment 208 houses a power source 205 configured to power the light bulbs 202A. In the embodiment illustrated, the power source 205 is implemented as one or more batteries 205A and 205B that are ideally commercially available to a general consumer. By way of non-limiting examples, the one or more batteries 205A and 205B may include one or more cylindrically-shaped alkaline batteries (e.g. size AA, size AAA, and the like) and/or one or more coin-type lithium batteries (e.g. a CR-type battery). The battery compartment 208 may be affixed to the trouser leg 300 (see FIGS. 5, 7, 8, 11, and 12) and/or the lighted hem protector 201 with, for example, fasteners, adhesive, latches, hinges, welding techniques, or any other method known to those of ordinary skill in the art. For example, the battery compartment 208 may be affixed to the interior side 324 (see FIG. 11) of the fabric of the trouser leg 300.

The control means (e.g., the control switch 206) is configured to control the power source 205 to thereby cause the lighting element(s) 202 to activate (or turn on) and deactivate (or shut off). Optionally, the control means (e.g., the control switch 206) may cause the lighting element(s) 202 to light intermittently (e.g., blink) according to a programmed pattern. The control means may be a physical switch, a toggle, or a button that a user may operate. For example, as illustrated in FIG. 9, the control means may be implemented as the control switch 206, which is positioned directly on the housing of the battery compartment 208. The control switch 206 may be manually operable. In such embodiments, the control switch 206 is manually transitionable from an on position to an off position and vice versa. The control switch 206 activates the lighting element(s) 202 when the control switch 206 is in the on position and deactivates the lighting element(s) 202 when the control switch 206 is in the off position.

Alternatively, the control means may be wireless and may communicate with the battery compartment 208 wirelessly (e.g., via Bluetooth, WiFi, or another communication protocol that uses radio waves). Such a wireless control may be configured to instruct the power source 205 when to supply power to the lighting element(s) 202, which causes the lighting element(s) 202 to generate light. The wireless control may also be configured to instruct the power source 205 when to stop supplying power to the lighting element(s) 202, which causes the lighting element(s) 202 not to generate light.

Figure 12:
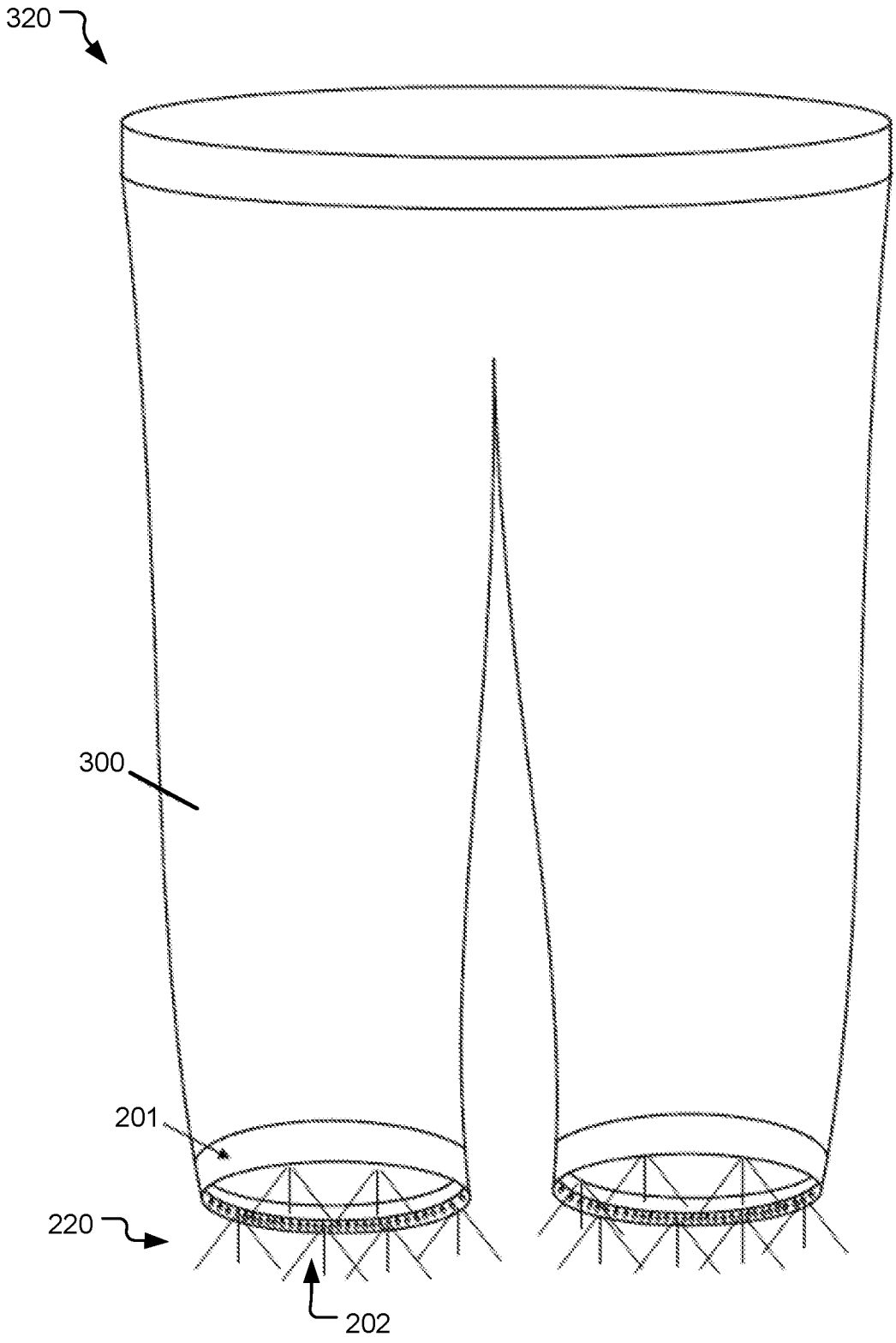
FIG. 12 is a top perspective view of light generated by a pair of lighted hem protectors illuminating outwardly from a pair of trouser legs.

FIG. 12 depicts illumination 220 provided by the hidden and battery operated lighting element(s) 202 when the lighted hem protector 201 is installed along the edge 310 (see FIG. 7) with the lighting element(s) 202 positioned on the inside of the trouser leg 300 of the trousers 320. In some embodiments, the inwardly facing side (not shown) and/or the outwardly facing side 210 (see FIG. 9) of the lighted hem protector 201 may have a reflective coating (not shown) that prevents light from penetrating or shining through the lighted hem protector 201. A reflective tape (not shown) may be applied between the outwardly facing side 210 (see FIG. 9) and the lighting element(s) 202 to prevent light generated by the lighting element(s) 202 from illuminating the trouser leg 300.

Referring to FIG. 8, the hem protector 101 and the lighted hem protector 201 (see FIGS. 9, 11, and 12) may each be used to hide a torn, frayed, stained, ruined, old, and/or damaged hem along the bottom of the leg 300 of the trousers 320 (see FIG. 12). The hem protector 101 and the lighted hem protector 201 (see FIGS. 9, 11, and 12) may each be used to cover a hem with colorful and/or decorative designs. A pair of hem protectors each like the hem protector 101 or the lighted hem protector 201 (see FIGS. 9, 11, and 12) may be used to make the trousers 320 (see FIG. 12), such as a pair of jeans, look like new again. The pair of hem protectors may be colorful or colored (e.g., with a plain blue denim color) to match the trousers 320 (see FIG. 12). For example, when the pair of hem protectors are colored and/or patterned to resemble blue denim, the hem protectors are not noticeable on a pair of jeans because the hem protectors are the same color as the jeans.

A pair of hem protectors each like the hem protector 101 or the lighted hem protector 201 (see FIGS. 9, 11, and 12) may be used to help keep a new pair of jeans looking new a lot longer than if the hem protectors were not used. Without the hem protectors, the hems along the bottom of the legs of the jeans will get soiled, wet, dirty, torn, stained, and frayed. In other words, when installed on the hems along the bottom of the legs of the jeans, the pair of hem protectors help keep the jeans looking new and clean longer. This may be particularly desirable for light or white colored jeans. Jeans can be expensive and the hem protectors can be used to preserve and protect them. The hem protectors may be constructed in different colors shades and/or with glitter. The hem protectors may sparkle or be clear. As discussed above, the hem protectors may be invisible when installed on the trousers 320 (see FIG. 12). Quotes and/or catch phrases may be printed on the hem protectors.

A pair of hem protectors each like the hem protector 101 or the lighted hem protector 201 (see FIGS. 9, 11, and 12) may be used to temporarily hem up and shorten the lengths of the legs of the trousers 320 (see FIG. 12). This avoids the need for expensive and permanent alterations by a seamstress. Further, the pair of hem protectors may be used to temporarily shorten the legs of the trousers 320 (see FIG. 12) to desired lengths when the wearer is wearing sneakers or flats. Then, the pair of hem protectors may be removed when the wearer is wearing shoes with high heels and there is no need to shorten the lengths of the legs of the trousers 320 (see FIG. 12).

Referring to FIG. 9, the lighted hem protector 201 may include the strip 203 of the light bulbs 202A (e.g., LEDs) that are powered by the power source 205 (e.g., the batteries 205A and 205B). Referring to FIG. 12, when the lighted hem protector 201 is installed on the leg 300 and the strip 203 (see FIG. 9) is illuminated, the strip 203 is hidden inside the leg 300 and sheds light (e.g., the illumination 220) on the wearer's walkway. A pair of lighted hem protectors each like the lighted hem protector 201 may be used to shine light on the wearer's shoes (e.g., high heels). The pair of lighted hem protectors may be used to create an illuminated lampshade effect with respect to the trousers 320 (e.g., a pair of jeans) because the illumination 220 originates from inside the legs of the trousers 320 and escapes through the openings (e.g., the opening 312 illustrated in FIG. 11) at the bottom of the legs of the trousers 320.

Referring to FIG. 8, the hem protector 101 and the lighted hem protector 201 (see FIGS. 9, 11, and 12) may each be non-permanent and/or disposable. Thus, referring to FIG. 7, a used (e.g., old and/or dirty) hem protector may be removed from the edge 310 and thrown away. Then, a new hem protector may be peeled from the backing 102 (see FIGS. 1 and 6) and stuck onto the edge 310 to protect the covered portion of the edge 310 as described above. Alternatively, the hem protector 101 and/or the lighted hem protector 201 (see FIGS. 9, 11, and 12) may be configured to be affixed to the edge 310 permanently.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

It is to be understood that the present disclosure of the invention includes all possible combinations of the features disclosed and/or illustrated in the drawings. For example, where a particular feature is disclosed in the context of a particular embodiment, that particular feature can also be used, to the extent possible, in combination with other embodiments.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

Accordingly, the invention is not limited except as by the appended claims.

What is claimed is:

1. A hem cover assembly for use with a wearer, a trouser leg, and footwear, the trouser leg being constructed from at least one material having interior and exterior sides with an edge therebetween that is positioned adjacent to the footwear when the trouser leg and the footwear are worn by the wearer, the hem cover assembly comprising:

a hem cover having an outwardly facing side opposite an inwardly facing side, the inwardly facing side comprising an adhesive layer, the hem cover being foldable to define first and second portions, the outwardly facing side in the first portion comprising one or more lighting elements receiving electrical power exclusively from a single wire, the one or more lighting elements each comprising a wired end opposite an illuminated end, the single wire being connected to the wired end of each of one or more lighting elements, the adhesive layer in the first portion to be adhered to the interior side of the at least one material to position the one or more lighting elements inside the trouser leg with the illuminated end of each of one or more lighting elements facing downwardly when the trouser leg is worn by the wearer and the wired end of each of one or more lighting elements positioning the single wire above the one or more lighting elements when the trouser leg is worn by the wearer, the adhesive layer in the second portion to be adhered to the exterior side of the at least one material, the one or more lighting elements to shine light out through an opening in the trouser leg and onto the footwear when adhesive layer is adhered to the interior and exterior sides of the at least one material; and a backing adhered to the adhesive layer, the backing being removable from the hem cover to allow the adhesive layer to be adhered to both the interior and exterior sides of the at least one material along at least a covered portion of the trouser leg, the hem cover being constructed from a waterproof material, the hem cover to protect the covered portion from moisture and from being soiled by an outside environment when (a) the wearer walks in the outside environment, (b) the hem cover is adhered to the at least one material, and (c) the trouser leg is worn by the wearer.

2. The hem cover assembly of claim 1, wherein the outwardly facing side of the hem cover comprises a single solid color or one or more colors arranged in a pattern or abstract design.

3. The hem cover assembly of claim 1, wherein the outwardly facing side of the hem cover is configured to match the at least one material such that the hem cover blends visually with the at least one material when the hem cover is adhered to the covered portion.

4. The hem cover assembly of claim 1, wherein the hem cover comprises a polymer sheet.

5. The hem cover assembly of claim 4, wherein the polymer sheet has a thickness within a range of 2.5 thousandths of an inch to 3 thousandths of an inch.

6. The hem cover assembly of claim 1, wherein the one or more lighting elements comprise a plurality of light bulbs, and the hem cover assembly further comprises:

a power source connected to the plurality of light bulbs by the single wire, the power source to provide the electrical power to the single wire; and a manually operable switch having an on position and an off position, the manually operable switch activating the plurality of light bulbs when the manually operable switch is in the on position and deactivating the plurality of light bulbs when the manually operable switch is in the off position.

7. The hem cover assembly of claim 6, wherein light bulbs in the plurality of light bulbs are connected together by the single wire in series.

8. The hem cover assembly of claim 6, further comprising:

a compartment housing the power source, the manually operable switch being attached to the compartment, the compartment being attached to the hem cover and affixable to the trouser leg by the hem cover.

9. The hem cover assembly of claim 6, wherein the hem cover is to prevent the light generated by the plurality of light bulbs from shining through the hem cover when the plurality of light bulbs is activated.

10. The hem cover assembly of claim 6, further comprising:

reflective tape positioned between the outwardly facing side and the plurality of light bulbs, the reflective tape to prevent the light generated by the plurality of light bulbs from illuminating the trouser leg when the plurality of light bulbs is attached to the trouser leg and activated.

11. The hem cover assembly of claim 1, further comprising:

a power source connected to the one or more lighting elements by the single wire, the power source to provide the electrical power to the single wire; and a wireless control to instruct the power source when to supply power to the single wire causing the one or more lighting elements to generate the light, the wireless control to instruct the power source when to stop supplying power to the single wire causing the one or more lighting elements not to generate the light.

12. The hem cover assembly of claim 1, wherein the hem cover is transparent.

13. The hem cover assembly of claim 1 for use with the exterior side of the at least one material having a first pattern, wherein the outwardly facing side of the hem cover has a second pattern to match the first pattern such that the second pattern blends visually with the first pattern.

14. The hem cover assembly of claim 1, wherein the hem cover is at least partially opaque or translucent to mask or hide, from an outside observer, a portion of the exterior side to which the adhesive layer is adhered.

15. A hem cover for use with a wearer, a trouser leg, and footwear, the trouser leg being constructed from at least one material having an interior side and an exterior side, an edge being defined between the interior and exterior sides, the edge being positioned adjacent to the footwear when the trouser leg and the footwear are both worn by the wearer, the hem cover comprising:

an outwardly facing side having first and second side portions;

one or more lighting elements attached to the first side portion of the outwardly facing side, the one or more lighting elements each comprising a wired end opposite an illuminated end;

a single wire being connected to the wired end of each of one or more lighting elements, the one or more lighting elements to receive electrical power exclusively from the single wire;

an inwardly facing side opposite the outwardly facing side, the inwardly facing side comprising an adhesive layer, first and second adhesive layer portions of the adhesive layer being adherable to the interior and exterior sides, respectively, of the at least one material; and a fold defining the first and second side portions and the first and second adhesive layer portions, the first adhesive layer portion to temporarily adhere the first side portion to the interior side to position the one or more lighting elements inside the trouser leg with the illuminated end of each of one or more lighting elements facing downwardly when the trouser leg is worn by the wearer and the wired end of each of one or more lighting elements positioning the single wire above the one or more lighting elements when the trouser leg is worn by the wearer, the second adhesive layer portion to temporarily adhere the second side portion to the exterior side, the one or more lighting elements to shine light from inside the trouser leg outwardly and onto the footwear when the first and second adhesive layer portions are adhered to the at least one material, the hem cover covering a covered portion including the edge of the trouser leg when the first and second adhesive layer portions are adhered to the at least one material, the hem cover being exposed to an outside environment adjacent to the footwear when the first and second adhesive layer portions are adhered to the at least one material and both the trouser leg and the footwear are worn by the wearer, the hem cover being constructed from a waterproof material, the hem cover to protect the covered portion from moisture and from being soiled by the outside environment when (a) the wearer walks in the outside environment, (b) the hem cover is adhered to the at least one material, and (c) both the trouser leg and the footwear are worn by the wearer.

16. The hem cover of claim 15, wherein the outwardly facing side of the hem cover comprises a single solid color or one or more colors arranged in a pattern or abstract design.

17. The hem cover of claim 15, wherein the outwardly facing side of the hem cover is configured to match the at least one material such that the hem cover blends visually with the at least one material when the hem cover is adhered to the covered portion.

18. The hem cover of claim 15, wherein the hem cover comprises a polymer sheet.

19. The hem cover of claim 18, wherein the polymer sheet has a thickness within a range of 2.5 thousandths of an inch to 3 thousandths of an inch.

20. The hem cover of claim 15, wherein the one or more lighting elements comprise a plurality of light bulbs, and the hem cover further comprises:

a power source connected to the plurality of light bulbs by the single wire, the power source to provide the electrical power to the single wire; and a manually operable switch having an on position and an off position, the manually operable switch activating the plurality of light bulbs when the manually operable switch is in the on position and deactivating the plurality of light bulbs when the manually operable switch is in the off position.

21. The hem cover of claim 20, wherein the hem cover is to prevent the light generated by the plurality of light bulbs from shining through the hem cover when the plurality of light bulbs is activated.

22. The hem cover of claim 20, further comprising:

reflective tape positioned between the outwardly facing side and the plurality of light bulbs, the reflective tape to prevent the light generated by the plurality of light bulbs from illuminating the trouser leg when the plurality of light bulbs is activated.

23. The hem cover of claim 15, wherein the hem cover is transparent.

24. The hem cover of claim 15 for use with the exterior side of the at least one material having a first pattern, wherein the outwardly facing side of the hem cover has a second pattern to match the first pattern such that the second pattern blends visually with the first pattern.

25. The hem cover of claim 15, wherein the hem cover is at least partially opaque or translucent to mask or hide, from an outside observer, a portion of the exterior side to which the adhesive layer is adhered.

26. A method comprising:

adhering a first portion of an inwardly facing side of a hem cover to an exterior side of a trouser leg and exposing an outwardly facing side portion opposite the first portion to an outside environment;

folding the hem cover along an edge of the trouser leg, the edge being positioned adjacent to footwear when the trouser leg and the footwear are worn by a wearer;

adhering a second portion of the inwardly facing side of the hem cover to an interior side of the trouser leg and positioning an inwardly facing side portion opposite the second portion inside the trouser leg, the inwardly facing side portion comprising one or more lighting elements each comprising a wired end opposite an illuminated end, a single wire being connected to the wired end of each of one or more lighting elements, the one or more lighting elements to receive electrical power exclusively from the single wire, the illuminated end of each of one or more lighting elements facing downwardly when the trouser leg is worn by the wearer and the wired end of each of one or more lighting elements positioning the single wire above the one or more lighting elements when the trouser leg is worn by the wearer, the hem cover covering a covered portion of the trouser leg after the first and second portions are adhered to the exterior and interior sides, respectively, of the trouser leg, the hem cover being constructed from a waterproof material, the hem cover to protect the covered portion from moisture and from being soiled by the outside environment when the wearer walks in the outside environment wearing the trouser leg and the footwear; and illuminating the one or more lighting elements to shine light from inside the trouser leg onto the footwear.

27. The method of claim 26, further comprising:

removing a backing from the inwardly facing side of the hem cover to expose an adhesive layer that adheres the first and second portions to the exterior and interior sides, respectively, of the trouser leg.

28. The method of claim 26, wherein the hem cover is to hide the covered portion, and the covered portion includes a portion that is at least one of torn, frayed, ruined, stained, old, and damaged.

29. The method of claim 26, further comprising:

forming a temporary hem by folding a bottom portion of the trouser leg to shorten the trouser leg to a desired length and to define the edge before folding the hem cover along the edge of the trouser leg.

30. The method of claim 26, wherein the outwardly facing side portion has information printed thereupon, and the information is to be read by others (a) after the first and second portions have been adhered to the exterior and interior sides, respectively, of the trouser leg and (b) when the wearer walks in the outside environment wearing the trouser leg and the footwear.

31. The method of claim 26, wherein the hem cover is transparent.

32. The method of claim 26 for use with the exterior side of the trouser leg having a first pattern, wherein the outwardly facing side portion has a second pattern that matches the first pattern such that the second pattern blends visually with the first pattern.

33. The method of claim 26, wherein the hem cover is at least partially opaque or translucent to mask or hide, from an outside observer, a portion of the exterior side to which the first portion is adhered.

* * * * *